US008225908B1

(12) United States Patent
Schmutter

(10) Patent No.: US 8,225,908 B1
(45) Date of Patent: Jul. 24, 2012

(54) ELEVATOR ESCAPE SYSTEM INCLUDING ELEVATOR CAB DETACHABLE FROM AN INTERPOSING DEVICE

(76) Inventor: Bruce E. Schmutter, Brooklyn, NY (US)

( * ) Notice: Subject to any disclaimer, the term of this patent is extended or adjusted under 35 U.S.C. 154(b) by 530 days.

(21) Appl. No.: 11/974,503

(22) Filed: Oct. 11, 2007

Related U.S. Application Data

(60) Provisional application No. 60/851,139, filed on Oct. 11, 2006.

(51) Int. Cl.
*B66B 1/28* (2006.01)

(52) U.S. Cl. ..... 187/247; 187/401

(58) Field of Classification Search ..... 187/247, 187/313, 380–388, 391–396, 401–403
See application file for complete search history.

(56) References Cited

U.S. PATENT DOCUMENTS

| | | | | |
|---|---|---|---|---|
| 1,301,924 | A * | 4/1919 | Evangelist | 187/348 |
| 4,364,453 | A * | 12/1982 | Serina | 187/289 |
| 4,434,875 | A * | 3/1984 | Scarzella | 187/285 |
| 4,488,621 | A * | 12/1984 | Schiewe | 187/347 |
| 4,533,021 | A * | 8/1985 | Perez de la Orden | 187/290 |
| 4,592,450 | A * | 6/1986 | Schaffer | 187/270 |
| 5,979,607 | A * | 11/1999 | Allen | 187/390 |
| 6,352,136 | B1 * | 3/2002 | Shih | 187/250 |
| 6,464,041 | B1 * | 10/2002 | Chen | 187/290 |
| 6,561,318 | B1 * | 5/2003 | Lamb | 187/263 |
| 6,625,934 | B1 * | 9/2003 | McGrath, III | 52/27 |
| 6,730,802 | B2 | 5/2004 | Shen et al. | |
| 6,778,071 | B2 * | 8/2004 | Megerle | 340/332 |
| 6,942,067 | B2 * | 9/2005 | Cholinski et al. | 187/258 |
| 7,051,842 | B2 * | 5/2006 | Chen | 187/306 |
| 7,182,174 | B2 * | 2/2007 | Parrini et al. | 182/18 |
| 7,461,723 | B2 * | 12/2008 | Kawai | 187/313 |
| 7,588,126 | B2 * | 9/2009 | Siikonen et al. | 187/384 |
| 7,594,564 | B2 * | 9/2009 | Siikonen et al. | 187/384 |
| 7,637,354 | B2 * | 12/2009 | Kawai | 187/313 |
| 2005/0031843 | A1 | 2/2005 | Robinson et al. | |
| 2006/0054420 | A1 * | 3/2006 | Gordon et al. | 187/313 |
| 2010/0187045 | A1 * | 7/2010 | Ishikawa | 187/290 |

OTHER PUBLICATIONS

U. Sorathia, et al., "Evaluation of Intumescent Coatings for Shipboard Fire Protection," Journal of Fire Sciences, Nov. 2003, vol. 21, No. 6, pp. 423-450.

* cited by examiner

*Primary Examiner* — Anthony Salata
(74) *Attorney, Agent, or Firm* — Nixon Peabody LLP

(57) ABSTRACT

Methods and devices for rescuing an elevator cab occupant. An emergency escape system can be integrated or retrofitted with an elevator. The emergency escape system includes an interposing device configured to attach to the elevator cab and to lower the elevator cab in an intelligent manner in the event of an emergency. The elevator cab may include an emergency cable that attaches the elevator cab to the interposing device and can be used either manually or automatically to lower the elevator cab during an emergency. The emergency escape system may include a thermal information system device, or sensors, which may provide real time environmental conditions of the dwelling and of the elevator occupants that can be communicated to first responders via a wireless protocol. In the event of building power loss, the cab power and the ability to communicate with the outside world may be unaffected. The emergency escape system may be thermally fortified. The emergency escape system may further include a rescue housing that may ascend and descend.

16 Claims, 15 Drawing Sheets

ELEVATOR ESCAPE SYSTEM INCLUDING ELEVATOR CAB DETACHABLE FROM AN INTERPOSING DEVICE

CROSS-REFERENCE TO RELATED PATENT APPLICATION OR PRIORITY CLAIM

This application claims the benefit of the Provisional Application No. 60/851,139, filed on Oct. 11, 2006, the disclosure of which is incorporated herein in its entirety by reference.

FIELD OF THE INVENTION

The present invention relates to intelligent, integrated systems and devices to allow elevators to be used safely and efficiently in the event of an emergency.

BACKGROUND OF THE INVENTION

Because of inherent risks associated with using an elevator during a fire, elevator systems are currently underutilized as evacuation vehicles. However, in a large multistory building, such as a high-rise, skyscraper, and some mid-rises, an elevator may present the only viable means of escape. This reality became all too apparent to the witnesses of the 9/11 terrorism attack who watched in horror as occupants of the upper floors of the twin towers jumped out of windows to their deaths.

There is typically a brief period of time between the initial detection of the fire and the point when combustion produces dangerous amounts of smoke and toxic fumes, in which the elevators of the building could be safely used to evacuate a fire zone of the building.

Up until 1973, elevators remained active during a fire, permitting a car full of people to arrive at the fire floor with tragic results. Because of this dangerous situation, Phase I—Emergency Recall Operation is now required on all U.S. elevators by ASME A17.1 *Safety Code for Elevators and Escalators*. Phase I is initiated automatically by the detection of smoke in an elevator lobby or initiated manually with a security key by the fire department from the ground floor lobby.

Phase II—Emergency In-Car Operation is also required to allow the fire service override access to the car. Phase II is used only when the hoistway is free from both smoke and water and when reliable power is available.

The U.S. Fire Administration estimates that every year more than 120,000 fires occur in buildings taller than three stories in height. Mid-rises, buildings between three and seven stories, account for the majority of these fire incidents. The annual occurrence of fires equates to one fire for every six U.S. mid-rise buildings currently in existence. High-rise buildings account for about 40,000 of these fires, or about one fire per existing high-rise per year. Most of these fires are in residential-type occupancies.

Due to the unfortunate frequency of false alarms, rampant skepticism regarding the validity of an alarm has added a layer of complexity and danger to the evacuation process. Many occupants will not leave a building that is on fire until they smell smoke or until a human voice orders them to evacuate. According to follow-up interviews with actual fire incident evacuees, the time from first hearing an alarm to beginning any evacuation may exceed thirty minutes.

Removing the elevator as an option for escape may be a death sentence to the elderly, the very young and the disabled. The fire stairs, which may offer an ideal means for evacuation to the able-bodied may not be a realistic option for many.

Ambulatory elderly and children are slower to evacuate and may adversely affect their own and other occupants' evacuation time. People with permanent disabilities may not be able to evacuate at all. Temporarily disabled people, relying on crutches, leg casts or foot braces, may suffer the same plight as the permanently disabled.

Despite advantages associated with using elevators as a means of escape during an emergency, especially for a certain segment of the population, the Fire Protection Inspector Bill Kuehner has written: "In fire evacuation plans for high-rise buildings, the plans make a point to state that elevators are not to be used in the event of fire. For many, these plans may seem contradictory, because everyone wants to exit the building as quickly as possible, But there are significant reasons why people should not use an elevator during a fire evacuation."

The Americans with Disabilities Act (ADA), which was enacted in 1990 to assure all people equal access to buildings used by the general public, does not provide a protected way out of buildings during building emergencies. People who cannot descend the stairs must wait for a firefighter and other first responder to rescue them. While typically a fire department response time is only six to seven minutes, it can take thirty minutes or more to reach people waiting in the fire zone.

OVERVIEW

In the United States, elevator control systems are connected to the fire alarm panel in order to facilitate the initiation of Phase I Operation. This connection is capable of more than just recall. In a manner similar to receiving distinctive signals from hall call stations and the car controller, the elevator controller is capable of receiving distinctive signals from the fire alarm panel about the precise location of signaling smoke detectors.

Prior to the activation of either Phase I or Phase II, during Phase III—Emergency Evacuation Operation, elevator cars could be used as the first means of egress for building occupants. When smoke is first detected, regardless of the alarm location, elevator cars could immediately drop passengers off at the primary exit floor. Then the elevator cars could be automatically dispatched to the fire zone and move building occupants to a safe location several floors below the fire.

During Phase III Operation, signals from the hall call stations would be overridden in favor of the fire zone. This zone—the fire floor, the floor immediately below the fire floor and the two floors above the fire floor—would be established by smoke detection or the location of the first signaling. As the fire progresses, the elevator controller could receive additional location signals from the building smoke detectors as they go into alarm. When smoke is finally detected in an elevator lobby, Phase I—Emergency Recall Operation could be initiated.

Phase III—Emergency Evacuation Operation data could be sent to the fire department via the phone line connection in the fire alarm panel. The first responding fire personnel could arrive at the building with current information on fire location and spread, as well as the status of the evacuation of the building's occupants. Minor fire alarm panel modifications could allow the fire department to control the elevator evacuation either from the station or from mobile fire equipment.

Building occupants typically revert to their habitual behavior when faced with a difficult emergency situation. They normally arrive and depart from the upper floors of the building via the elevator and few have ever used the fire stair system. Frightened occupants typically go directly to the elevators, frantically pushing the call button immediately below the DO NOT USE ELEVATOR DURING A BUILD- ING FIRE sign. Phase III Operation could capitalize on this response. Those at the greatest risk and with the least time to think rationally could be evacuated via the elevator.

Given the inherent unpredictability of the progress of a fire, dangers of electrocution, and other risk factors associated with using an elevator system as a means of escape, a need exists for a system that can provide real time information to first responders regarding the progress of the fire, the location of elevator cabs and occupants, communication means operable in the absence of power to the building, means for safeguarding the elevator cab occupants from electrocution, thermal fortification, and means for rescuing trapped elevator cab occupants in the event of loss of power to the elevator system.

The present embodiments provide an intelligent emergency escape system which permits an elevator to be converted into a life pod in the event of an emergency. The emergency escape system can be integrated or retrofitted with existing conventional elevator systems. The emergency escape system, according to an embodiment, comprises an interposing device configured to attach to the elevator cab during normal operation and disengage from the elevator cab in the event of an emergency in order to provide a means of descending the elevator cab. In an embodiment, the elevator cab is equipped with an emergency cable that couples to the interposing device and that can be used to lower the elevator cab in the event of an emergency. In an embodiment, the cab can be lowered using an automatic winch system. In another embodiment, the elevator cab can be lowered manually. The emergency escape system may include its own power source and may be operable in the event that power is lost to the transfer cables of the elevator and in absence of communication with the roof mechanics of the elevator. The emergency escape system may include a thermal information system device, or sensors, which may provide real time environmental conditions of the dwelling and of the elevator occupants that can be communicated to first responders via a wireless protocol. In the event of building power loss, the elevator cab's power and the ability to communicate with the outside world may be unaffected. In an embodiment, the emergency escape system is thermally fortified. The emergency escape system may further comprise a rescue housing, which may provide ascent and descent for first responders, elevator occupants, and medical devices.

Additional aspects of the present invention will be apparent in view of the description which follows.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

Embodiments of the present invention are described herein in the context of a method, system and apparatus for providing an intelligent, integrated emergency escape system. Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings. The same reference indicators will be used throughout the drawings and the following detailed description to refer to the same or like parts.

DESCRIPTION OF EXAMPLE EMBODIMENTS

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that a development effort might be complex and time-consuming, but would nevertheless be a routine undertaking of engineering for those of ordinary skill in the art having the benefit of this disclosure.

In accordance with the present disclosure, the components, process steps, and/or data structures described herein may be implemented using various types of operating systems, computing platforms, computer programs, and/or general purpose machines. In addition, those of ordinary skill in the art will recognize that devices of a less general purpose nature, such as hardwired devices, field programmable gate arrays (FPGAs), application specific integrated circuits (ASICs), or the like, may also be used without departing from the scope and spirit of the inventive concepts disclosed herein. Where a method comprising a series of process steps is implemented by a computer or a machine and those process steps can be stored as a series of instructions readable by the machine, they may be stored on a tangible medium such as a computer memory device (e.g., ROM (Read Only Memory), PROM (Programmable Read Only Memory), EEPROM (Electrically Erasable Programmable Read Only Memory), FLASH Memory, Jump Drive, and the like, magnetic storage medium (e.g., tape, magnetic disk drive, and the like), optical storage medium (e.g., CD-ROM, DVD-ROM, paper card and paper tape, and the like) and other known types of program memory.

Figure 1:
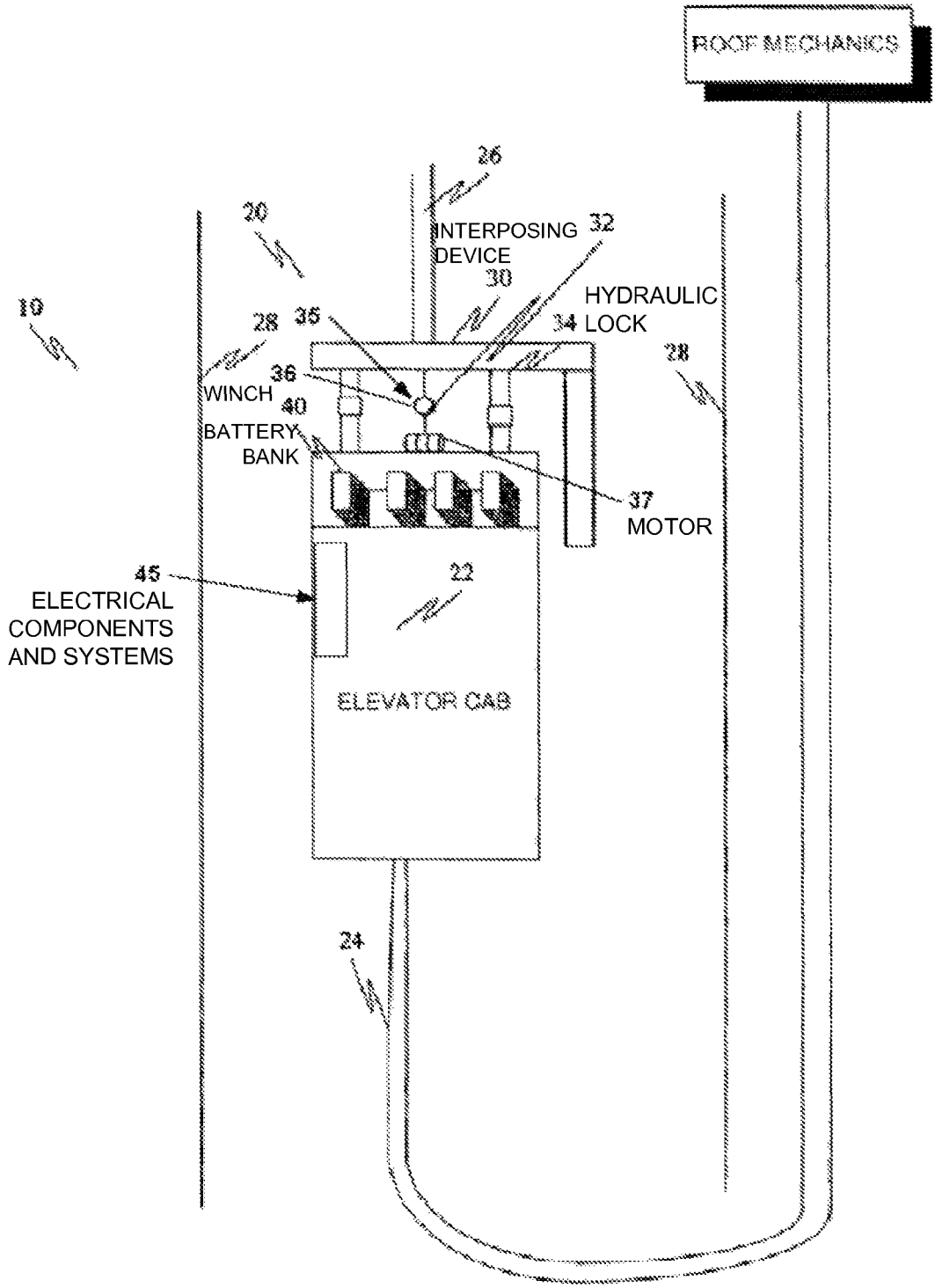
FIG. 1 is a schematic illustrating components of an emergency escape system.

FIG. 1 is a perspective view of an emergency escape system 10, configured to attach to an elevator 20. The elevator 20 may comprise an elevator cab 22, transfer cable 24, lift cable 26, shaft 28, and roof mechanics 29. The emergency escape system 10 can be integrated or retrofitted with the elevator 20. The emergency escape system 10 can save the lives of both building inhabitants and rescuers by converting an elevator into an intelligent life pod in the event of an emergency.

The emergency escape system 10, according to an embodiment comprises an interposing device 30 configured to attach to the elevator cab 22 and to the lift cable 26 of the elevator. In an embodiment, the interposing device 30 comprises thermally fortified steel that is configured to provide impact protection to the elevator cab 22. In an embodiment, a fire resistant panel, or ZPanel™ can be attached to the interposing device, as well as other structures of the interposing device, in order to protect the structure from fire or heat.

In an embodiment, the interposing device 30 may be attached to the elevator cab 22 during normal operation with a hydraulic lock 34 or other coupling means that is capable of detachment in the event of an emergency. The interposing device 30 comprises an emergency cable 32. The emergency cable 32 may comprise one or more counterweights. In a particular embodiment, the interposing device 30 may be configured to shield the elevator cab in the event of a collision on the anterior end of the cab or on one or more sides.

In an embodiment, the elevator cab 22 may comprise an emergency cable 32 that can be used to lower the cab 22 by either manual or automated means. In an embodiment, the emergency cable 32 can be used to lower the cab 22 using suitable lowering means such as an automatic motorized winch system 35. As shown in FIG. 1, the automatic motorized winch system 35 includes a winch 36 coupled to a motor 37.

In an embodiment, an optional rechargeable battery back 40 is attached to the top of the elevator cab 22 and provides power to the cab's electrical components and systems 45, as well as the lowering means 35 in the event of an emergency. Power provided by the battery bank 45 may substitute for power from a conventional transfer cable 24. In an embodiment, the battery bank 45 comprises a 12 VDC generator that can be recharged through the normal ascent and descent of the elevator 20. The emergency escape system 10 is operable in the event that all power is lost to the elevator.

Figure 2:
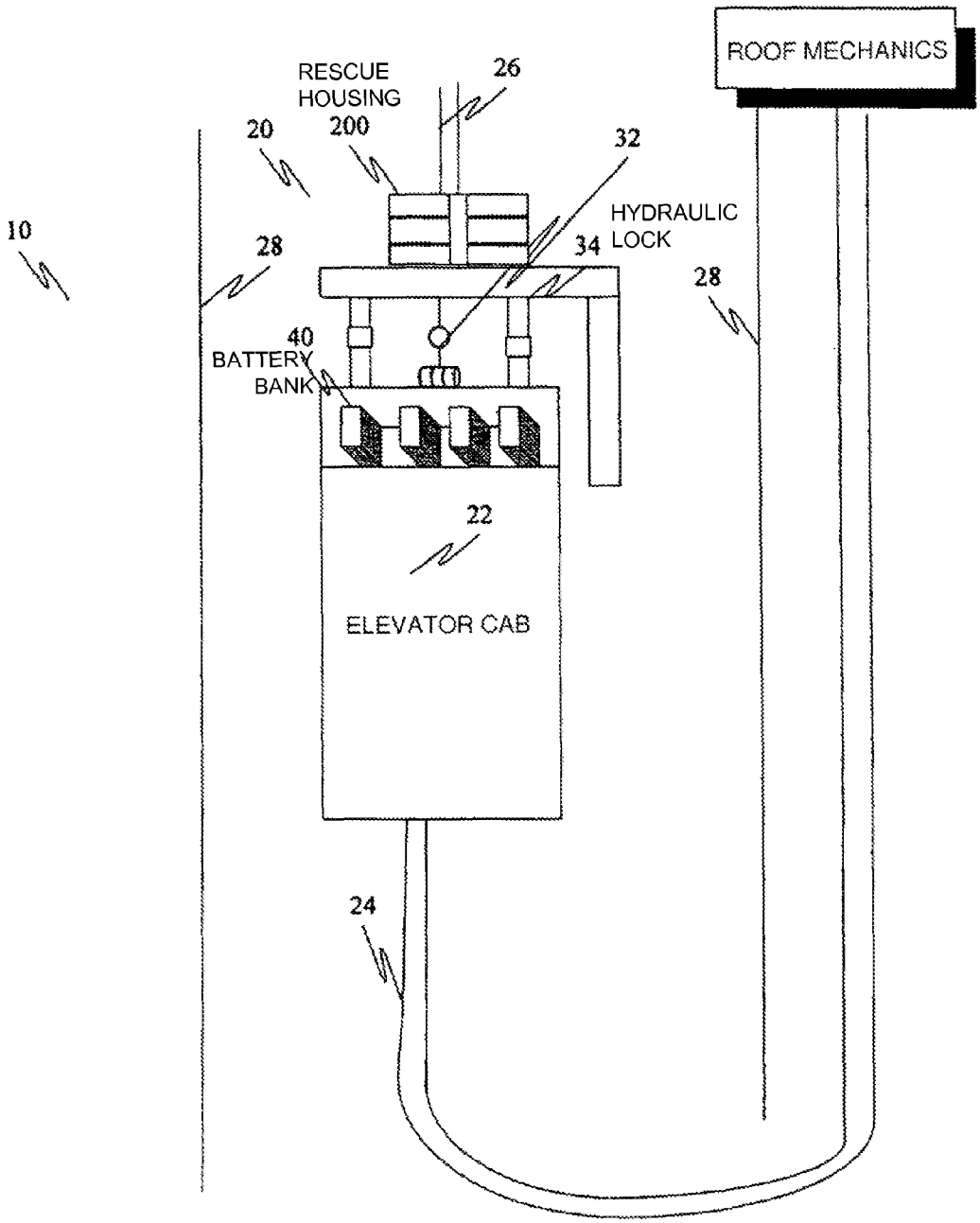
FIG. 2 is a schematic illustrating components of an emergency escape system in accordance with an embodiment of the present system.

Turning to FIG. 2, in accordance with the present disclosure, the emergency escape system 10 may further comprise a rescue housing 200 that can be configured to engage the lift cable 26 of the elevator 20. The rescue housing, like the elevator cab, is adapted to send and receive wireless communications from authorized facility personnel, first responders, as well as other facility communication devices. In an embodiment, the rescue housing 200 is a cage. In a particular embodiment, the rescue housing 200 is a basket. The rescue housing 200 may have its own independent power and drive capabilities. The rescue housing 200 may be powered by a separate battery bank. The rescue housing 200 may be mounted to the roof of the building.

By way of non-limiting example, a first responder (e.g., firefighter or EMT) may signal the rescue housing 200 wirelessly to engage and raise itself to the rescuer's location. Using such means of wireless communication, the rescuer may deliver emergency medical devices, such as a defibrillator, via the rescue housing 200. The rescuer may enter the rescue housing 200, descend to the location of the elevator cab 22 and safely lower the elevator cab 22. In an embodiment, where environmental conditions warrant, when the rescue housing 200 reaches the elevator cab 22, the rescuer extricates the occupant and takes him to a higher floor rather than descend with the elevator cab.

In one embodiment, the rescue housing 200 is transportable so that a firefighter or other first responder can bring the rescue housing 200 with him to the site of the emergency and retrofit the rescue housing 200 to the elevator. In an alternative embodiment, the rescue housing 200 is maintained as part of the emergency escape system 10.

Figure 3:
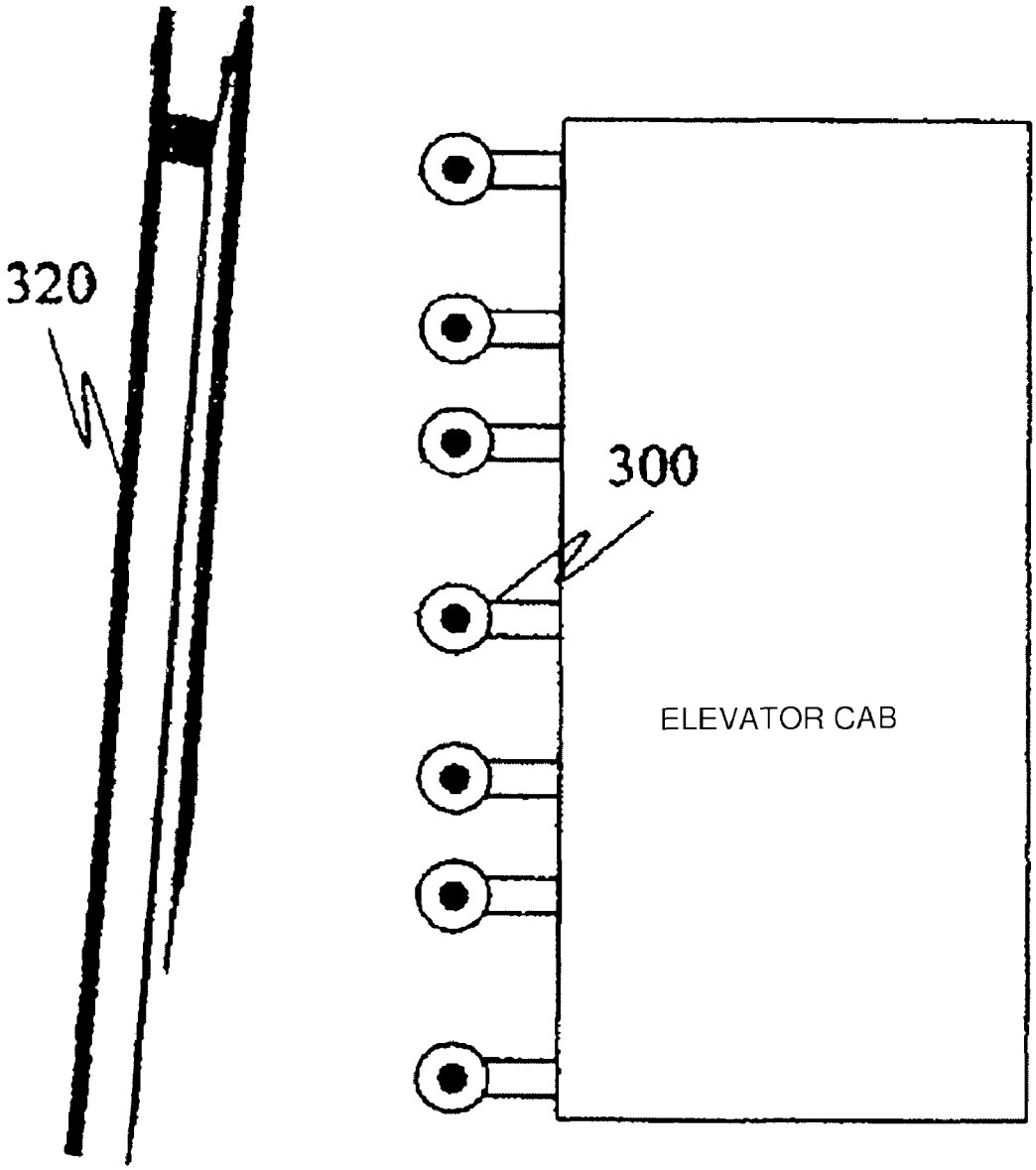
FIG. 3 is a side view of a elevator cab and a shaft in accordance with an embodiment of the present system.

Turning to FIG. 3, the elevator cab 22 may have rollers 300. In an embodiment, the elevator cab 22 may be disengaged from the interposing device and the rollers 300 of the elevator cab 22 may engage guide rail 320 of the elevator shaft 28. The disconnection of the elevator cab 22 from the elevator's interposing device 30 and connection to the guide rails 320 may either be automated or may be carried out manually. In an embodiment, the interposing device 30 may be fixed to the elevator guide rail 320 via the operating brakes at a point in the immediate vicinity of the breaks of the elevator.

In accordance with the present disclosure, occupant and environment sensors provide first responders with situational awareness. The building itself may convey information to a fire station, and the rescuers. In an embodiment, adjacent environmental real time status updates are delivered directly to a first responder's mask or other video or LCD display. One or more sensing devices may be coupled to each floor of the building, including the lobby, to the elevator cab 22, to the interposing device 30, and to the elevator shaft 28. The sensors may be configured to obtain ambient information relating to temperature. The sensors may also detect human occupancy of each floor and of a structure's elevator cabs. In an embodiment, the sensors use infrared technology to detect the number of occupants. In an embodiment, the sensors can be used to verify whether an alarm has properly been setoff by a building occupant. In an embodiment, redundancies in the sensors can be used to verify whether one sensor has properly diagnosed an emergency situation.

One or more controllers may be coupled to each sensor, wherein each controller further includes a local processor configured to provide a control signal to a fire station, police station, emergency room, or other emergency unit and to a central computer located in the building or other structure, such as in the lobby of the building and more specifically to the lobby elevator landing; a communication device coupled to the local processor and configured to provide communications between the local processor and one or more sensing devices.

In a specific embodiment, a host computer is coupled to each controller via each communication device and configured to control each controller. In another embodiment, each sensing device and each controller is thermally fortified to function within a temperature range from about −40 degrees Fahrenheit to about 2100 degrees Fahrenheit.

In still another embodiment, each sensing device comprises one or more sensors capable of detecting substances such as, for example, noxious gasses including, but not limited to, carbon monoxide, carbon dioxide, chlorine, cyanogen, flourine, hydrogen cyanide, nitric oxide, nitrogen tetraoxide and phosgene. In another embodiment, each sensing device comprises one or more sensors capable of detecting substances such as, for example, combustible gasses including, but not limited to, oxygen, hydrogen, acetone, acetylene benzene butane butyl alcohol (butanol), diethyl ether, ethane, ethyl alcohol (ethanol), ethylene, ethylene oxide, hexane, isopropyl alcohol (isopropanol), methane, methyl alcohol, methyl ethyl ketone, n-pentane, propane, propylene styrene, toluene, and xylene. In another embodiment, each sensing device comprises one or more sensors capable of detecting toxic gasses as well as oxygen displacing gasses and other gasses hazardous to human health as typically defined by OSHA, or otherwise known by those of skill in the art. In another embodiment, each sensing device comprises one or more sensors capable of detecting dangerous and/or harmful radioactive, chemical or biochemical agents.

In an embodiment, each controller is configured to process one or more single or grouped Doppler radar signals. In another embodiment, the communication device provides wireless communications between the local processor and the host computer. In another aspect of the disclosure, the host computer is capable of instructing a local processor to open or close one or more elevator doors in response to ambient information obtained by a sensing device associated to one or more elevator doors which are not associated with the local processor.

Following the Lessons Learned Information Sharing Protocol, the communication network, of which the emergency escape system is a part, is capable of presenting the current global status of the monitored structure in a realistic three dimensional CAD interactive rendering which accurately represents the information in real time in an intuitive manner.

The emergency escape system may also be capable of communicating the significance of monitored events to system users in an optimal manner by providing current, historical and anticipated values with design and safety limit parameters for effective comparison. The term system users includes any person using the system such as, for example, the staff of the structure and emergency first responders.

In an embodiment, the emergency escape system informs the first responder of the precise location of where the fire started and whether any other floors are affected, whether or not a floor still exists, and, if so, if it has collapsed into the floors below. The emergency escape system may also inform the first responders whether there is someone in an elevator cab, the location of the elevator cab, and whether it is safe to ascend or descend to the elevator cab.

A control unit of the emergency escape system may provide the occupant of the elevator with a signal telling him that a call to the firefighters has gone out, and help is on its way.

In an embodiment, once a firefighter has located the elevator cab within the structure, the firefighter's communicator requests the landing door to open. The firefighter's communicator requests the rescue housing to engage and raise itself to the floor where the firefighter is located. Meanwhile, the emergency escape system closes the elevator landing doors on the floor where the elevator cab is located, maintaining compartmentation and minimizing air exchange. When the firefighter reaches the elevator cab, he can then safely disengage it from the interposing device and lower it in accordance with the information collected by the sensors. The elevator cab may then jettison from the main lifting system and self lower to the lobby. If a lower floor then fills with smoke and is no longer tenable, the system warns the firefighter not to return. Prior to reaching the elevator landing, the adjacent controller recognizes the first responder and polls the lobby sensors. The nearest elevator landing site may recognize the emergency responder, and the untenable conditions are directly communicated to both the first responder and the rescue housing controller. This advanced warning may stop the first responder from entering the unsafe area, provide him with an alternative route of escape, or provide him with the information necessary to combat the conditions by the most appropriate means possible. Meanwhile, a command post may simultaneously receive the information, and a second team may be detached. The second team may then be dispatched and the situation may be neutralized.

In accordance with another embodiment, when the rescue housing reaches the elevator cab, the firefighter can safely extricate the occupant from the elevator cab and use the housing to ascend to a floor with a viable means of egress.

In one embodiment, the communication means of the emergency escape system 10 installed just above a subway platform landing, notifies a first responder that power failure has occurred. The first responder on the concourse level interfaces with the elevator landing door, which opens. The door signals the roof-mounted rescue housing. The rescue housing, having its own independent power and drive capabilities, automatically engages in a self-raise mode ("autopilot") and provides ascent and/or decent to both the first responder and the elevator occupant depending on the real time conditions of the building.

The communication system of the escape system is also capable of incorporating redundant onboard and remote journals of the event and the response requiring the controller state of alarm to remain persistent until both the alarm condition is removed and an acknowledgement by an authorized individual had been appropriately executed in a timely fashion.

In an embodiment, the emergency escape system both records and recommends based upon trending and audits on multiple controllers' journals. The emergency escape system may determine alarm thresholds from additional real time lessons learned. The new alarm criteria may be broadcasted to appropriate controllers throughout the system to be considered in the logic solve process. Redundant systems validation coupled with self-healing capabilities ensure that the emergency escape system is reporting reliable, verifiable real time situational awareness.

By way of a non-limiting example, if a system sensor detects fire or smoke, an alarm will be activated, alerting facility staff to investigate and take remedial action with respect to the source of the alarm. Even if the system sensor no longer detects fire or smoke, the alarm will persist until the system confirms that an authorized individual has appropriately responded to the alarm. In this instance, the alarm state could only be shut off after the system has detected the RFID of an authorized maintenance employee in the same physical area of the sensor that initiated the alarm. In this way, the system provides assurance that the situation that precipitated the initial alarm has actually been investigated by an authorized individual and responded to appropriately.

The current system is also capable of effectively monitoring system integrity using both wired and wireless communication channels at a consistent interval to serve as a "keep alive" bi-directional validation and incorporate qualified, encrypted "virtual signature" signals. Specifically, in an embodiment, the system communicates using pulse width modulation (PWM) signals.

The emergency escape system may be part of a facility management system that is able to prolong the operation of the system as well as the viability of means of pedestrian ingress/egress within the system when the facility is under duress by utilizing robust components with vibration mountings and thermal protection for both system and facility vertical/horizontal thoroughfares. In an embodiment, the facility management system components are thermally fortified with fiberglass coated with a ceramic composite. In an embodiment, the facility management system components are thermally fortified with silica coated with a ceramic composite. In an embodiment, the ceramic composite is ZShield™ or an equivalent substance. The components of the present disclosure provide universal switchable input output modules with 3.3-440 v ac/dc, and the transient protection meets ANSI C37.90 transient specification.

In an embodiment, components of the elevator escape system and other components of the facility management system are thermally fortified by surrounding them with flame and/or heat resistant materials. In one embodiment, the components are thermally fortified with silica coated with a ceramic composite. In an embodiment, the components are thermally fortified using a multilayered fire protective system including intumescent materials such as, for example, ZShield™ fire protective panels. In a particular embodiment the entire elevator cab is thermally fortified to withstand temperatures up to about 2100 degrees F. for up to about 1 hour. Accordingly, elevator cab occupants may be protected from even the most intense and catastrophic fire emergencies.

Methods for installing the fire resistant panels are also provided. In one embodiment, the installation method comprises affixing a panel to a portion of the escape system using an attachment means and a fire resistant belt, the fire resistant belt comprising at least one heat reflective layer having a length, a width, a first lateral surface and a second lateral surface; at least one impact resistant mechanical support layer having a length, a width, a first lateral surface and a second lateral surface; and, at least one intumescent layer having a length, a width, a first lateral surface and a second lateral surface, wherein the intumescent layer is positioned between the mechanical support layer and the heat reflective layer, and wherein the attachment means is positioned between the intumescent layer and the mechanical support layer. The attachment devices used in these installation methods may include any known thermally acceptable attachment devices.

Positioning the attachment devices between the intumescent layer and the mechanical support layer provides the additional advantage of protecting the attachment devices from any heat generated by a fire. Accordingly, in the event of an intense fire, the panels of the present invention will remain attached to walls and other substrates significantly longer than fire protective panels in which the attachment means are not shielded from the heat and flame of a fire.

In a particular embodiment, a multi-layer fire resistant material is used to thermally fortify the escape system and elevator communication system comprising at least one heat reflective layer having a length, a width, a first lateral surface and a second lateral surface; and at least one intumescent layer having a length, a width, a first lateral surface and a second lateral surface, wherein the at least one intumescent layer is positioned between a first reflective layer and a second reflective layer, and wherein the layers are affixed by a first attachment means able to withstand temperatures up to about 800° F. and a second attachment means able to withstand temperatures up to about 3000° F.

The reflective layer may be silica fiber, ceramic coated fiber, or any of numerous commercially available heat reflective materials. In an embodiment, the heat reflective material is a fabric or other suitable substrate treated with a silicon carbide precursor as described in U.S. Pat. No. 6,730,802, which is incorporated by reference herein in its entirety. In an additional preferred embodiment the silicon carbide precursor treated fabric is a fiberglass fabric such as S-Glass fiber. The intumescent layer of the present invention may be expandable graphite, unexpanded vermiculite, hydrobiotite, hydrogel and/or mixtures thereof. In an embodiment, the intumescent layer is expandable graphite.

In a particular embodiment, the layers of the fire resistant material are affixed in a quilted pattern, wherein a first reflective layer is affixed to a second reflective layer by a first attachment means able to withstand a temperature up to about 800° F. and a second attachment means able to withstand a temperature up to about 3000° F., and wherein the at least one intumescent layer is positioned between the first and second reflective layers. The dual attachment means allows the intumescent material to expand as the temperature increases, thus optimizing its insulating features. Specifically, at temperatures from about 800° F., the first means of attachment, such as thread stitching degrades from the heat. This allows a greater area in which the intumescent material can expand.

System assemblies utilized in the present disclosure are fabricated with industrial grade electrical, electronic and mechanical components which function within a temperature range from at least about −20 degrees C. to +80 degrees C. Thus, the components utilized in the present disclosure will typically have significantly longer useful lives compared with components that are commercially rated. In a particular embodiment of the present disclosure, printed circuit board (PCB) assemblies will have a conformal coating applied. Conformal coatings are specially formulated lacquers designed to protect PCBs and related equipment from their environment, thus improving and extending their working life, and ensuring security and reliability of performance. Conformal coatings protect circuitry from hazards including but not limited to damage from chemicals, vibration, moisture, salt spray, humidity and temperature. Component enclosures used in the present disclosure will also provide overall protection for the assemblies and offer dampening against shock and vibration. In a particular embodiment, ZShield™ sleeving is applied to one or more component of the emergency escape system.

Figure 4:
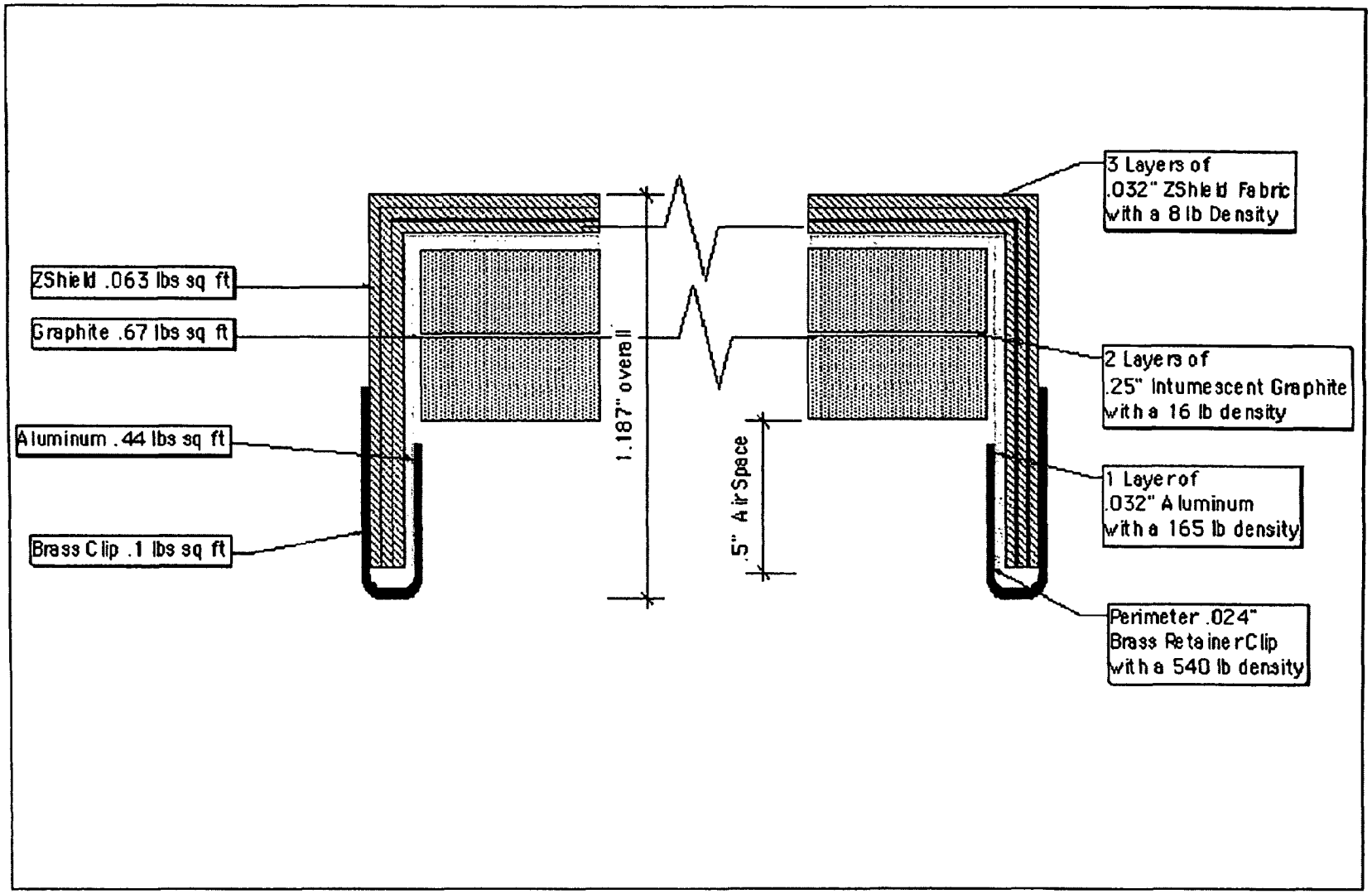
FIG. 4 is a schematic showing the design of a fire protective ZShield Panel™ in accordance with one embodiment of the present system.
Figure 5:
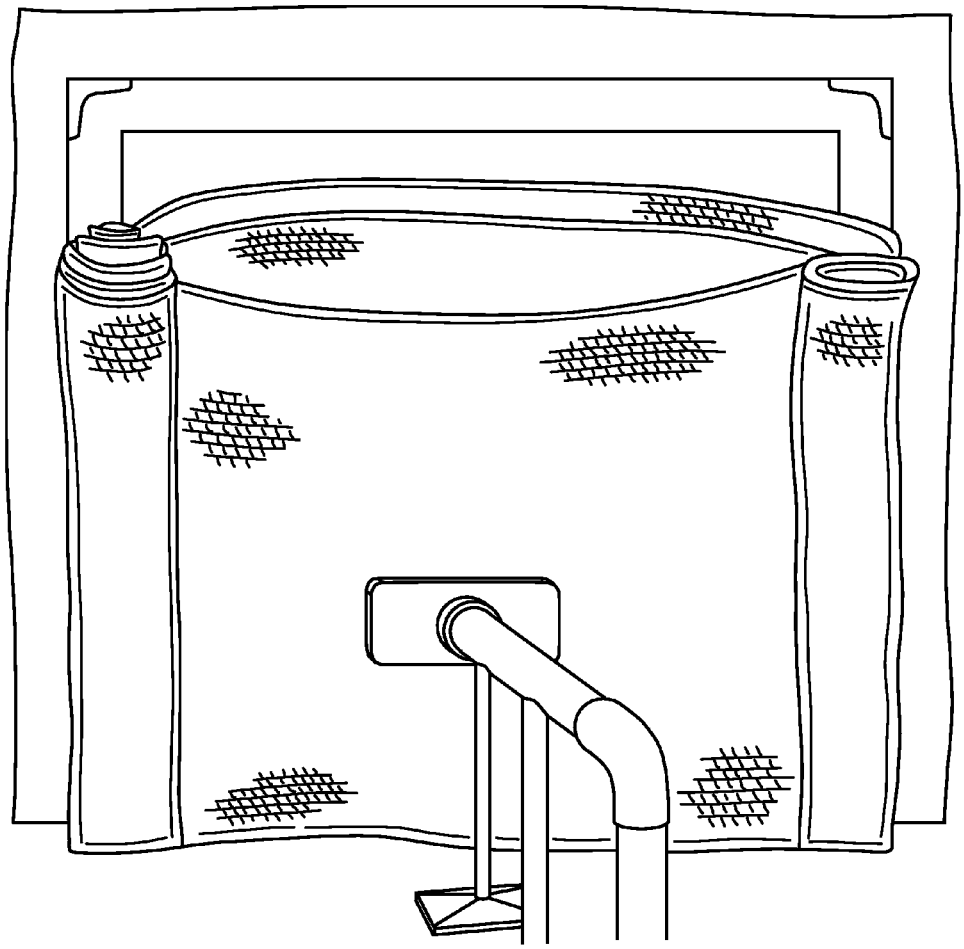
FIG. 5 shows a fire protective panel and an installation belt in accordance with another embodiment of the present system.

Fire resistant/protective panels (ZShield™ Panels) are provided in accordance with a particular embodiment which can be used to provide protective thermal layer for many types of substrates, structures and appliances. FIGS. 4 and 5 illustrate the design of a fire resistant panel in accordance with a particular embodiment. The ZShield™ Panels have been tested in accordance with Underwriters Laboratories (UL) #1709 to 2000 degrees F. for two hours.

In a particular embodiment, the panels are affixed to the outer surfaces of an elevator cab to protect and insulate the cab, its key components and the elevator cab occupants. Accordingly, use of the fire resistant panels of the present invention can transform the elevator cab into a viable escape/rescue/evacuation vehicle which can be used to save lives in the event of a fire. The panels can be used on virtually any structure or other substrate in need of protection from fire and/or heat.

Figure 6A:
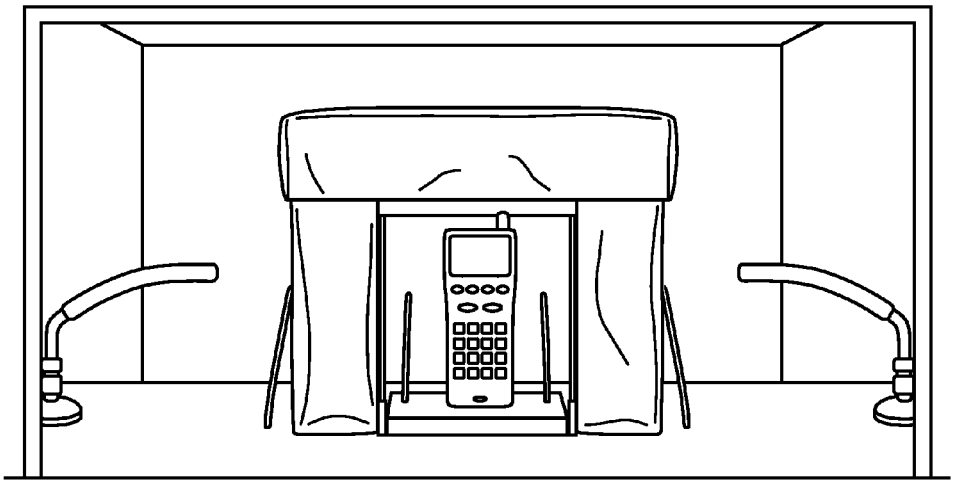
FIG. 6 shows a model of an elevator cab thermally fortified by fire resistant/protective panels in accordance with one embodiment of the present invention. (A) depicts the model enclosing an electronic device (radio); (B) depicts the thermally fortified model being heated on two opposing sides by propane torches.
Figure 6B:
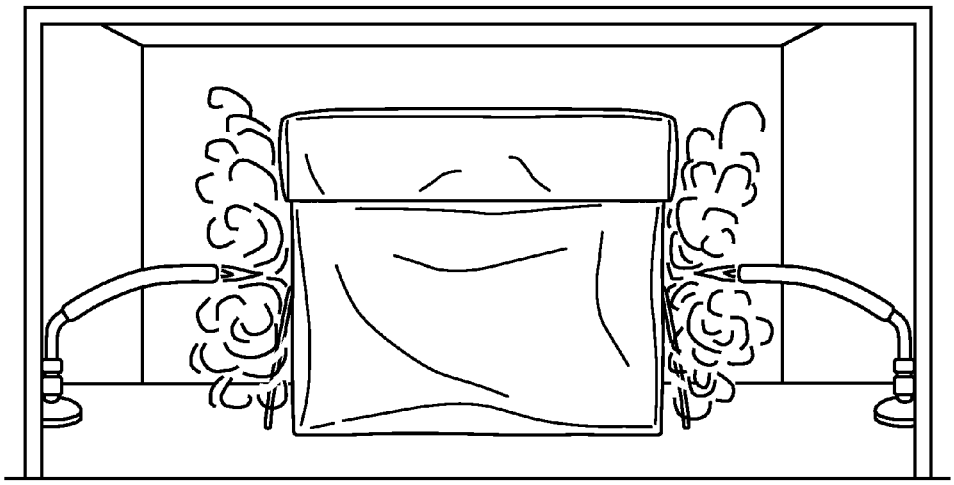

FIGS. 6A and B show a model of an elevator cab thermally fortified by fire protective panels in accordance with one embodiment. An elevator cab model was thermally fortified with fire resistant panels of the present disclosure. The model was then subjected to flame/heat testing by directing a propane torch flame at the external panel wall of the model. The temperature of the outer panel wall, the inner wall of the elevator cab model, and the ambient temperature of the elevator cab interior were then measured and recorded over a 45 second period of time. The results of the test demonstrated that although the outer wall of the model reached temperatures exceeding 1000° C., the temperatures of inner wall of the elevator cab and the ambient temperature of the elevator cab interior did not increase, but remained constant. The test demonstrated that thermal fortification with the fire protective panels of the present disclosure not only prevents an elevator cab from burning, it prevents the temperature of the inside of the elevator from rising, thus protecting the contents of the elevator cab from any heat damage in the event of a fire. In short, thermal fortification with suitable materials can transform an elevator from a death trap into a viable escape device which can preserve human life in even the most extreme fires.

The elevator communication system of the present disclosure comprises a microcontroller based controlling device having two primary constituent parts, hardware and firmware. The hardware reads, prepares and presents input information, and sets control states on output devices. The hardware also provides a number of internal resources such as storage, date and time facilities, communications channels and sound generation.

The hardware is made up from a series of electronic modules which are linked over an electrical bus structure. The hardware of the present disclosure implements bus structured architecture which allows adjustable count input and output resources in the form of plug-in modules. This architecture offers expandability in that additional modules may be included in the system. The expandable design of the system allows site specific features and capabilities to be efficiently implemented.

In a particular embodiment of the disclosure, the DDBus backplane is a printed circuit board (PCB) which carries signals between a control processor module and input and output (I/O) modules. The signal set on the DDBus backplane has address, control, data and power. The bus also has analog data which extends the data gathering capability of the system. In an embodiment of the disclosure, a wireless backplane is provided.

The DDB-PD8 module is designed with overvoltage and reverse voltage protection of the primary DC input voltage. The module not only provides a breakout terminal block for powering sensors, but also has measurement circuits for measuring, for instance, the current taken by the sensors. Module DDB-14V4 provides voltage and current measurements circuits. Monitoring of currents delivered to local devices such as alarm indicators is also possible.

The DDBus system accommodates multiple DDB-18 input modules in one example, each module has eight inputs. Overvoltage protection can be provided. Switches on the module allow Dry/Wet input selection. Up to four DDB-Qx output modules may be provided, these are typically relay modules for switching local loads. Alternate configurations such as high powered relay modules are also available. The processor module controls activity on the DDBus. Onboard resources may be Ethernet, USB. RS-232 and SPI communications. Storage for system state logging is normally provided. Additionally, debug facilities for system firmware troubleshooting is available throughout JTAG interfacing. The DDBus allows the interface with other controller devices. Motor controllers can also be integrated within the system.

Figure 7:
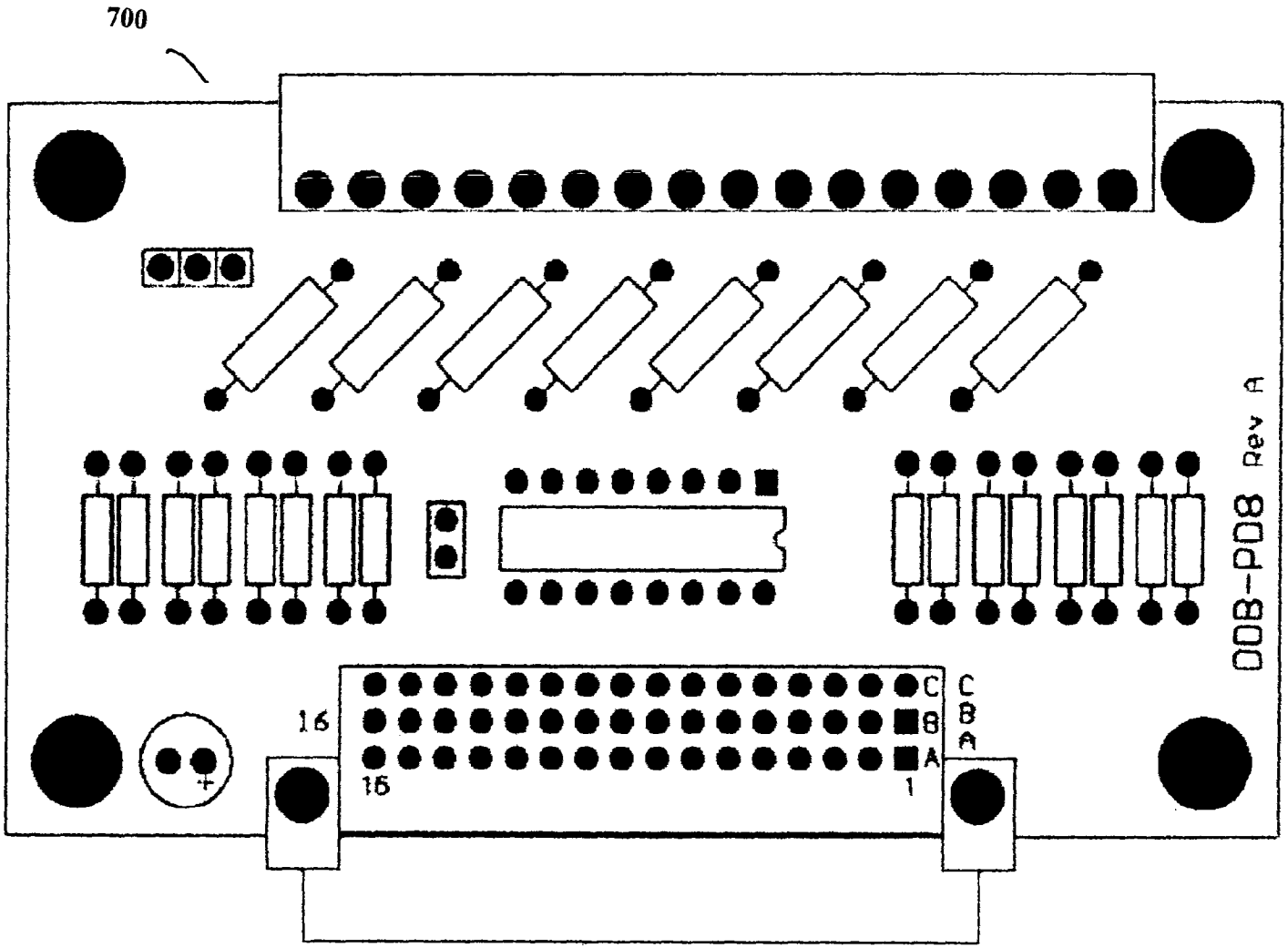
FIG. 7 shows a power distribution and power monitoring module for a facility management device.

FIG. 7 shows a power distribution and power monitoring module 700 for a facility management device that the elevator escape system may be a part of in accordance with the present disclosure. DDB-PD8 110 is the power entry point for the system's+24 Vdc and the +5 Vdc voltage rails. The DDB-PD8 110 breaks out the +24 Vdc to a front edge terminal block for powering sensors. The module 700 incorporates circuitry to allow the processor module to measure the current delivered to each sensor. Having the capability of measuring the current delivered to each sensor allows the system to validate the sensor's operation.

Figure 8:
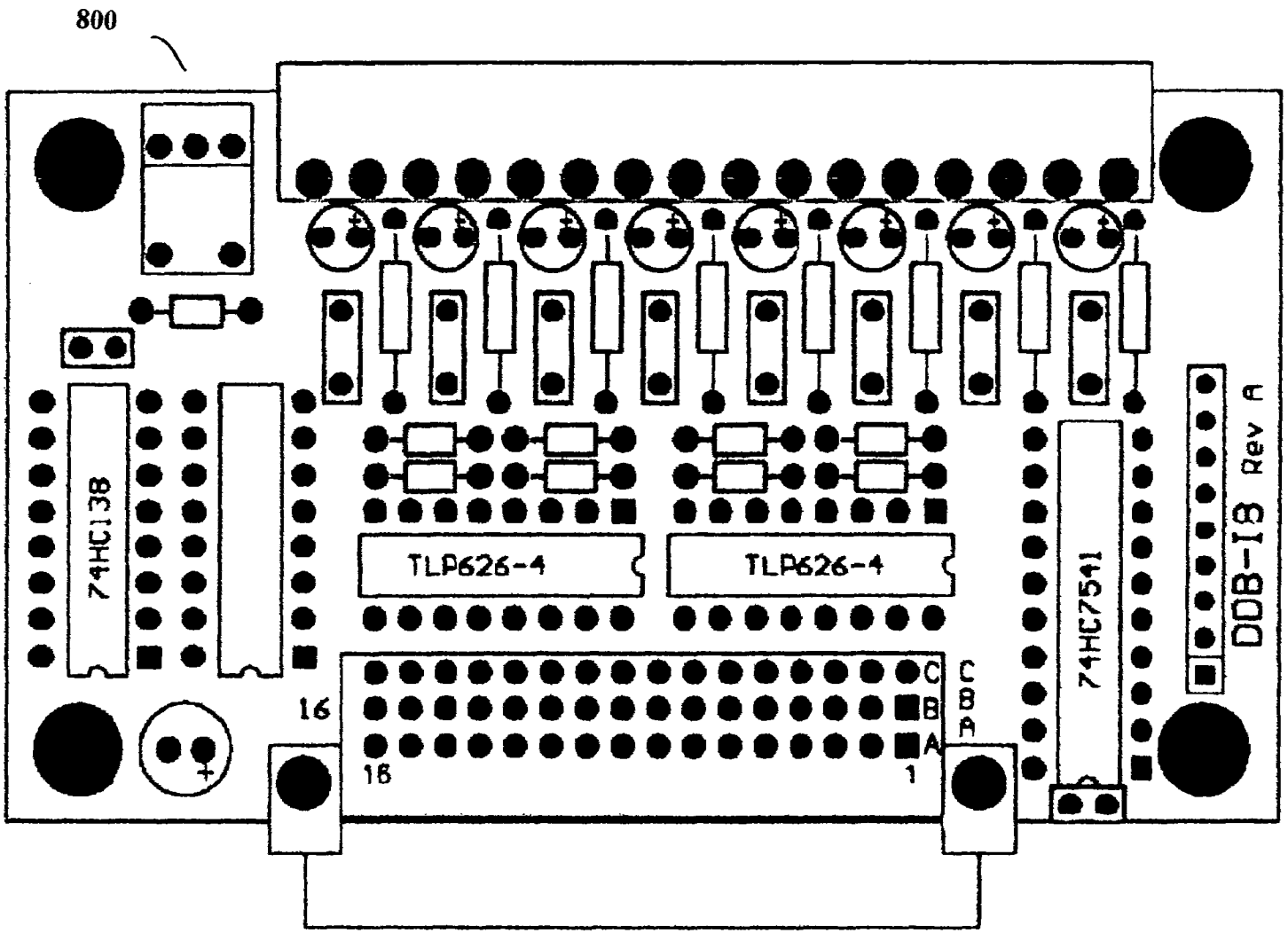
FIG. 8 shows a eight channel digital input module for an emergency escape system.

FIG. 8 illustrates an eight-channel digital input module 800 for a facility management device in accordance with one embodiment. DDB-18 1 14, has 8 opto-isolated inputs. Each input channel is selectable for dry or wet inputs. Over voltage protection is provided. Multiple input modules may exist within a system.

Figure 9:
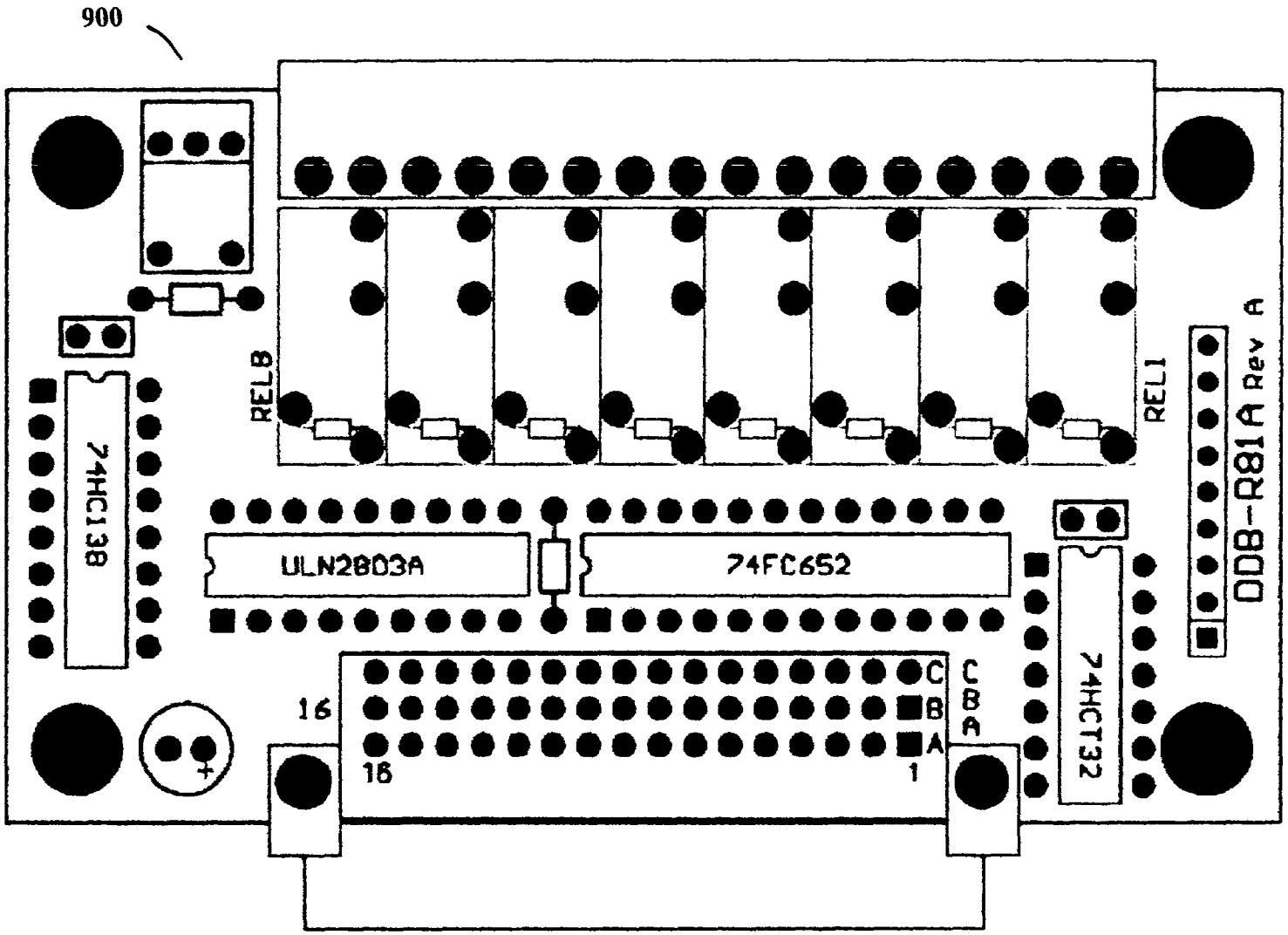
FIG. 9 shows an eight channel digital output module for the emergency escape system.

FIG. 9 illustrates an eight-channel digital output module 900 for a facility management system in accordance with one embodiment. DDB-Q8 116, provides eight digital switches for applying electrical power to output devices. Typical output devices can be solenoids, motors and alarms. Multiple output modules may exist within a system. Output modules with alternate arrangements to suit different circumstances are possible.

Figure 10:
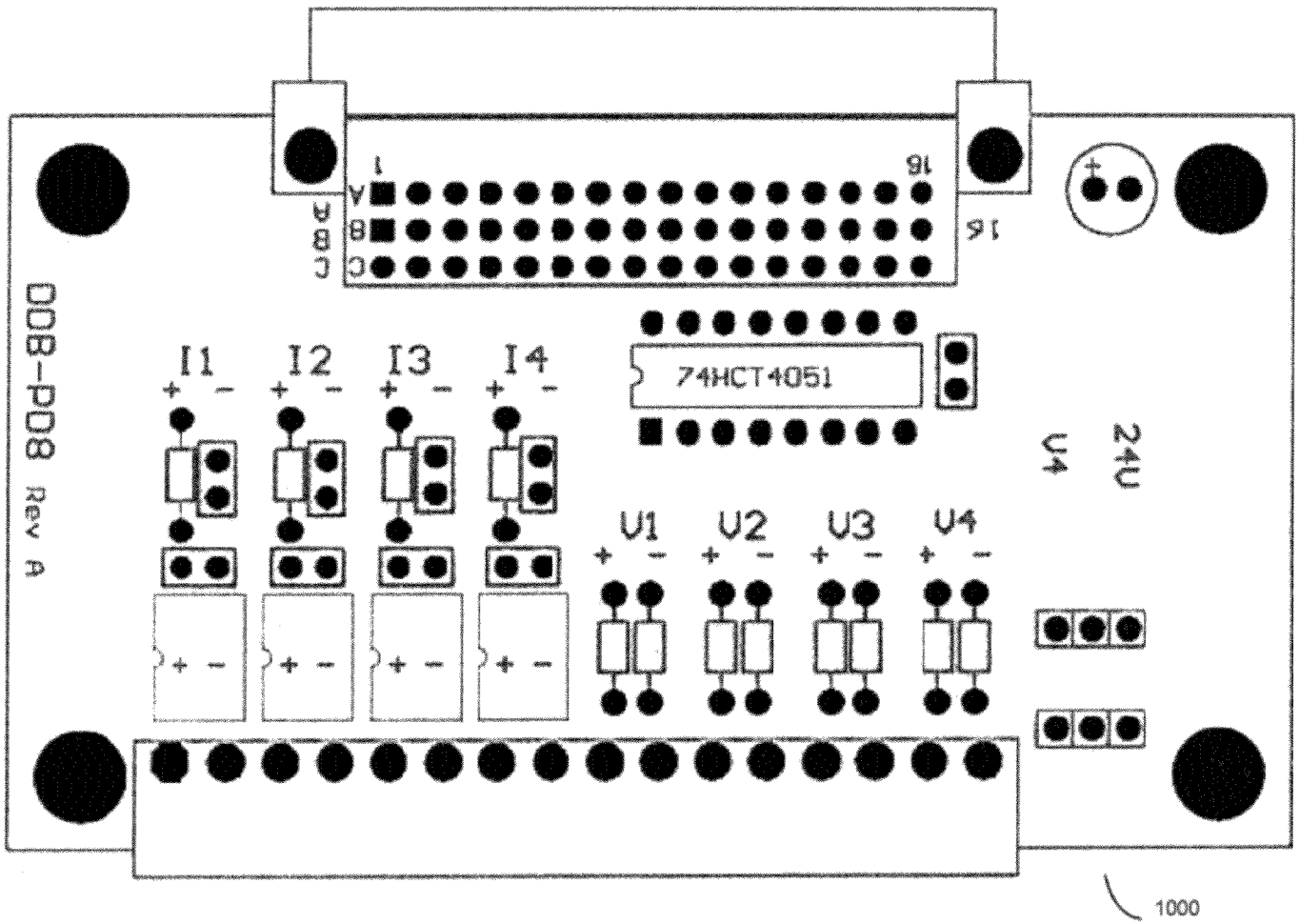
FIG. 10 shows an analog measurement module for the emergency escape system.

FIG. 10 shows an analog measurement module 1000 for the facility management device in accordance with one embodiment of the present invention. Module DDB-14V4's circuitry 112, is designed for the measurement of four voltages and four currents. Monitoring and validation of an output device's operation is possible with DBB-14V4 112. Modules with different mix of voltage and current measurements are possible.

Figure 11:
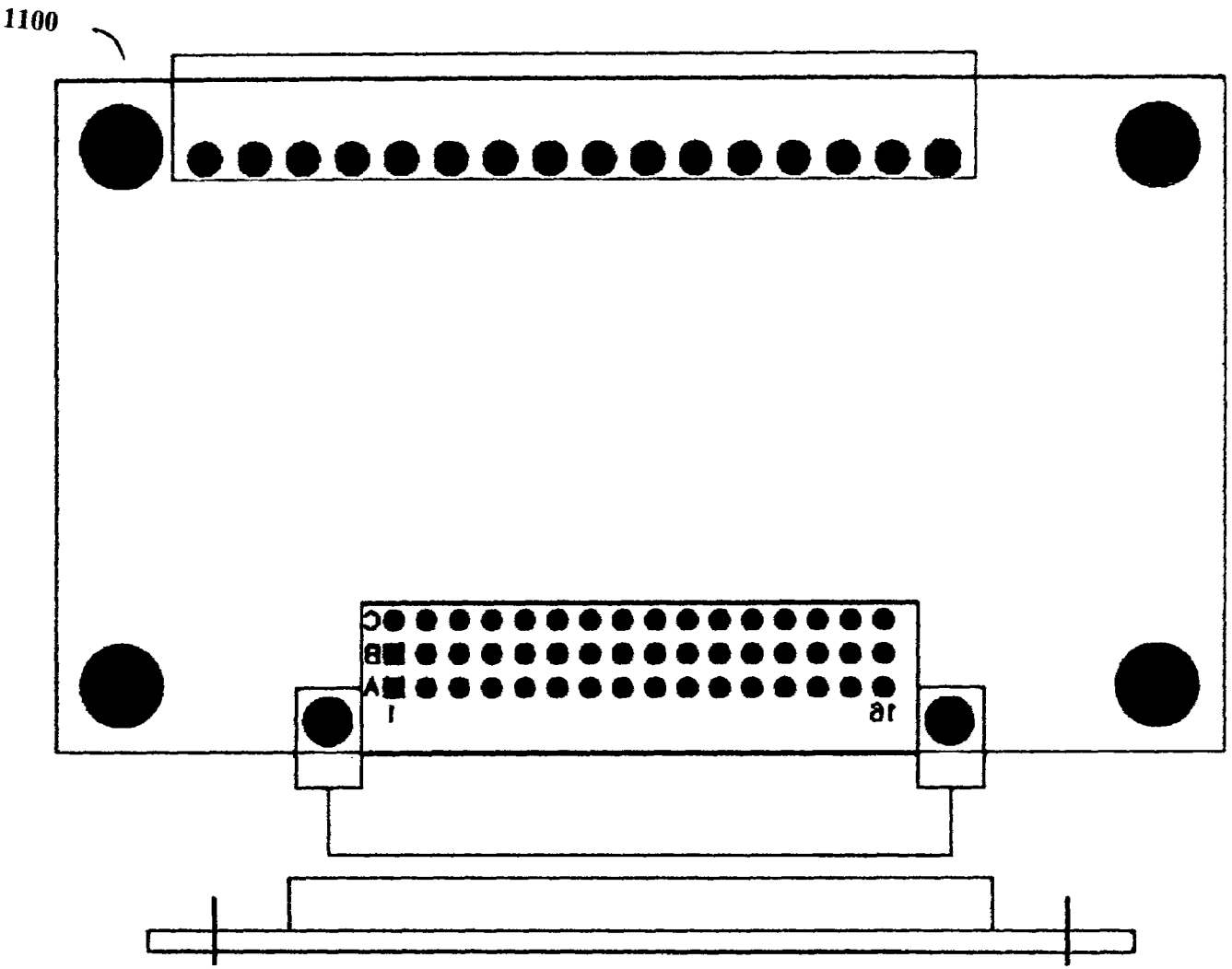
FIG. 11 shows an end view of a DDBus module mounted on a DDBus backplane.
Figure 12:
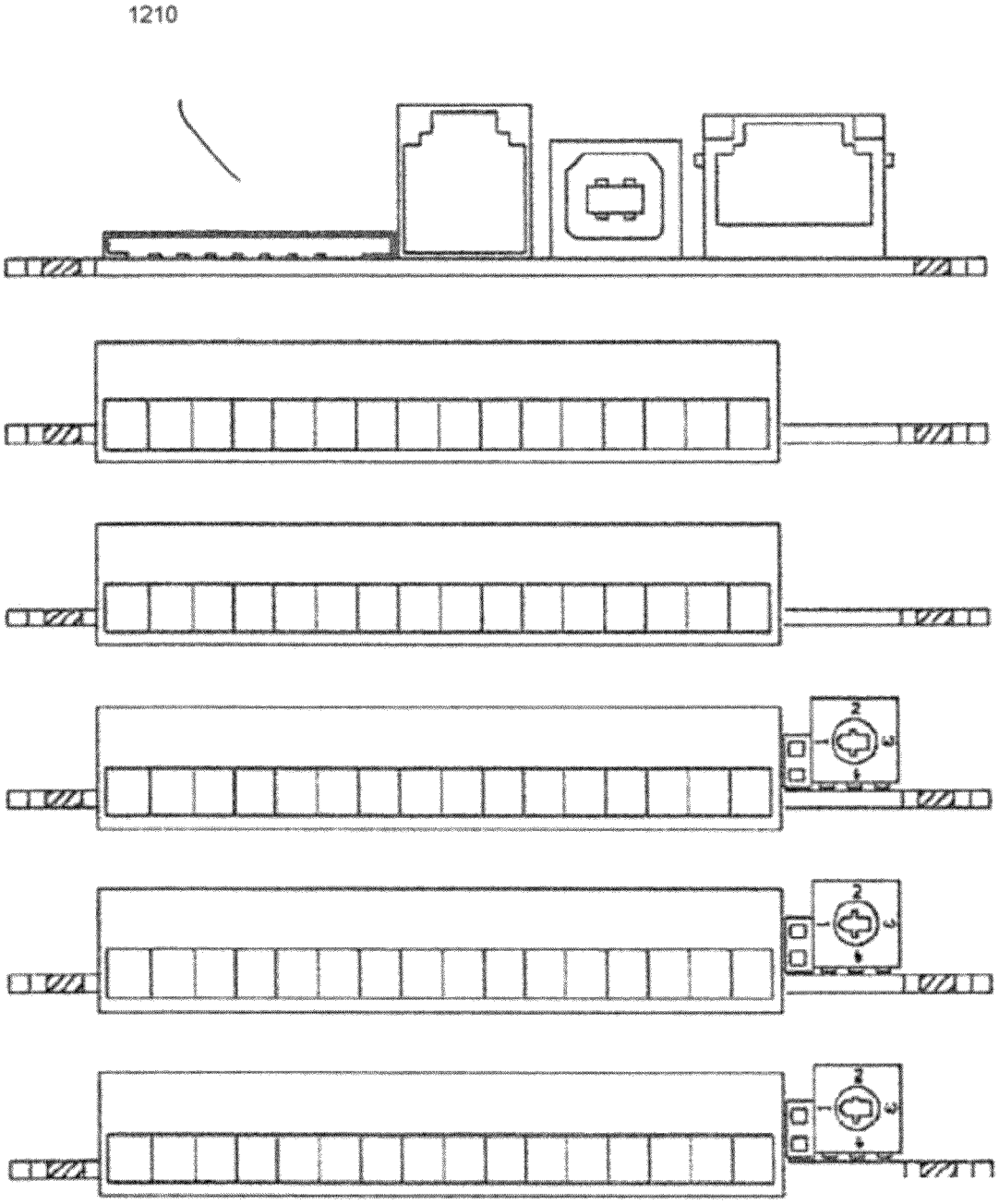
FIG. 12 shows a basic system consisting of, from left to right, a processor (DDB-CP32), power distribution (DDB-PD8), measurement module (DDB-I4V4, and a mix of input and output modules.

FIG. 11 illustrates an end view of a DDBus module 1100 mounted on a DDBus backplane in accordance with one embodiment. FIG. 12 shows a basic facility management device 1200 consisting of, from (left to right) a processor such as DDB-CP32, a power distribution such as DDB-PD8, a measurement module such as DDB-14V4, and a mix of input and output modules in accordance with one embodiment of the present invention.

Figure 13:
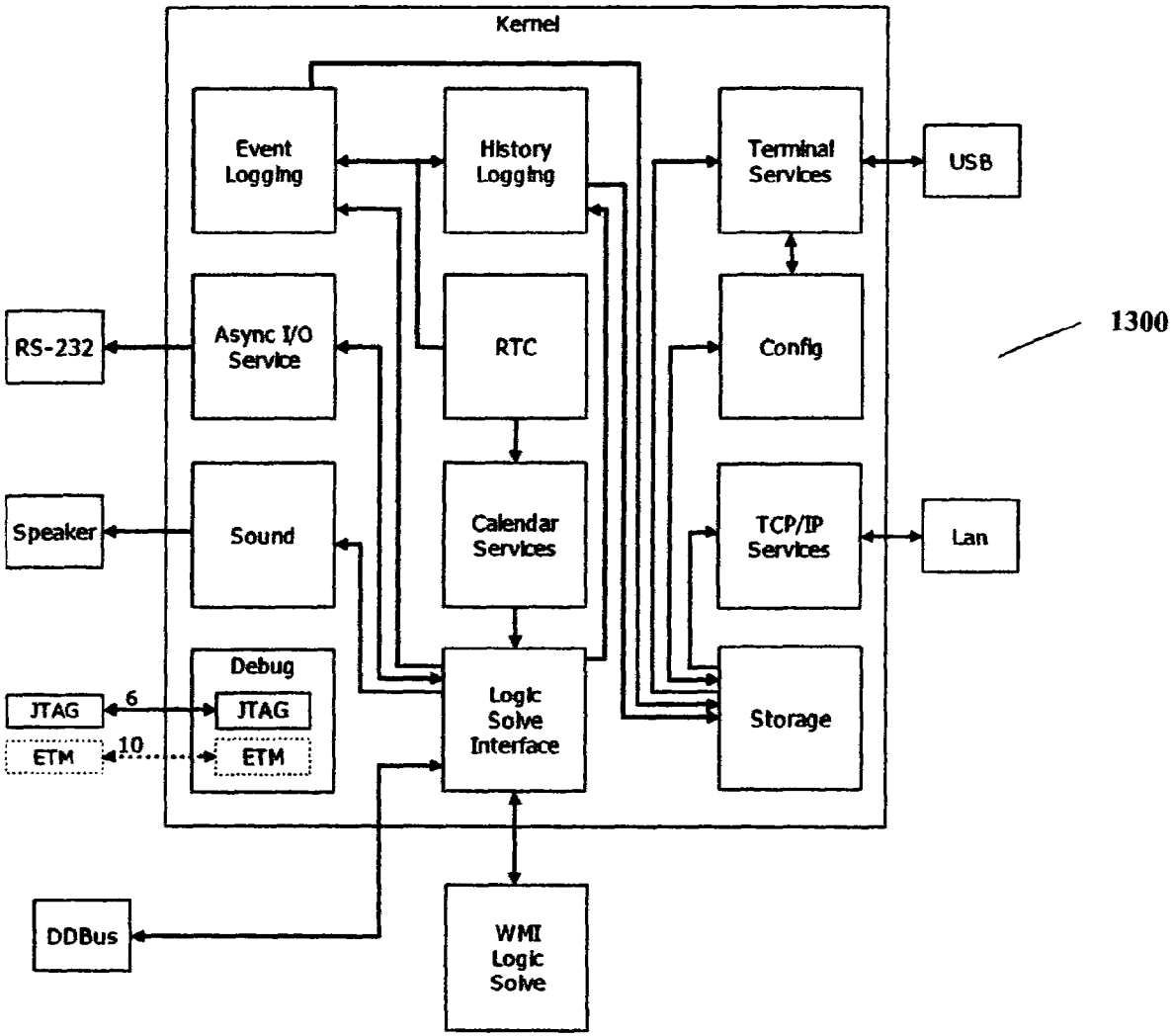
FIG. 13 is a schematic depicting firmware modules and their interaction.

FIG. 13 illustrates a schematic 1300 depicting firmware modules and their interaction. Schematic 1300 contains various firmware modules including an event logging, a history logging, a terminal service, an service, a real time clock (RTC), a calendar services, and an Internet services. It should be noted that there could be additional firmware modules that are not illustrated in schematic 1300.

The software kernel of the disclosure provides a terminal service for the interchange of requests and responses between it and an external communications device. Incoming requests are responded to according to the type of request. The terminal service also provides data uploads and downloads.

Information that is specific to the facility management site is maintained within a data block. The information in this data block is configurable at any point in time through the terminal service. This information is reviewed by the kernel on system startup and actions initialization processes according to the configuration data.

The controller's hardware set includes a clock/calendar facility which includes a battery back-up so that time and date information are maintained if the primary power is removed. The date and time information are used to timestamp logged records. The RTC's date and time are maintained through the terminal service.

The calendar service uses the date and time from the real time clock to determine if the system is within a calendar period. It sets a flag accordingly which is made available to the logic solver. The calendar information consists of a table of pairs of dates and times. One of the pair is the start of the calendar period and the other is the end of the calendar period. The table is held in non-volatile core and can be maintained through the terminal service. A mass storage device is also maintained by the software kernel. It stores and retrieves information as required by the other services.

The event logging service of the disclosure allows the recording of conditions that are deemed significant. Both the kernel and the logic solver utilize this service. The kernel, for instance, records a system startup as an event. The kernel also records (as significant events), any adjustments made to the RTC, the configuration block and the calendar data.

History logging records the raw states of the logic elements associated with the logic solver. These are the physical inputs, the physical outputs, the internal states, timers and counters. At the end of a logic solve, should any change have occurred from the previous solution, a log will occur. Depending on the amount of mass storage implemented, history may be recorded over many months.

The wmi controller may be capable of communicating by numerous methods ranging from copper wire based RS-485 to sophisticated wireless communications channels. In a particular embodiment, the elevator communication system comprises a communication network in which, for example, one controller node is able to communicate with any other controller node (point to point) or to communicate with multiple controller nodes (broadcast). "Node" as used herein refers to any device connected to a network, such as the communication network provided by the present disclosure. It will be understood by one of skill in the art that the nodes of the present disclosure can be passive or active. One example of a passive node is a controller such as described in the present disclosure. An example of an active node would be a first responder such as a fireman or paramedic who is equipped with a device capable of communicating with the elevator communication system of the present disclosure.

Accordingly, the particular network configuration provided by the present disclosure allows for a flexible hierarchical organization of data in which one controller may assume the role of a "parent" node which overseers the operations of numerous child controllers. The child controllers perform the actual signal input and signal output according to the requirements of the system. A particular parent node can also be managed or controlled by an upper level "grandparent" node, which in turn can be managed by a node higher still in the hierarchy. This node management organization can continue up through the hierarchy to a root node.

Each node of the system may be capable of journaling (logging or recording) their operations, cycle by cycle, over many months. Further each node of the system may be capable of communicating its particular journal record (log) onto its parent node, which in turn has its own journaling capability. These journals can be sampled at a lower rate than the constituent nodes.

Figure 14:
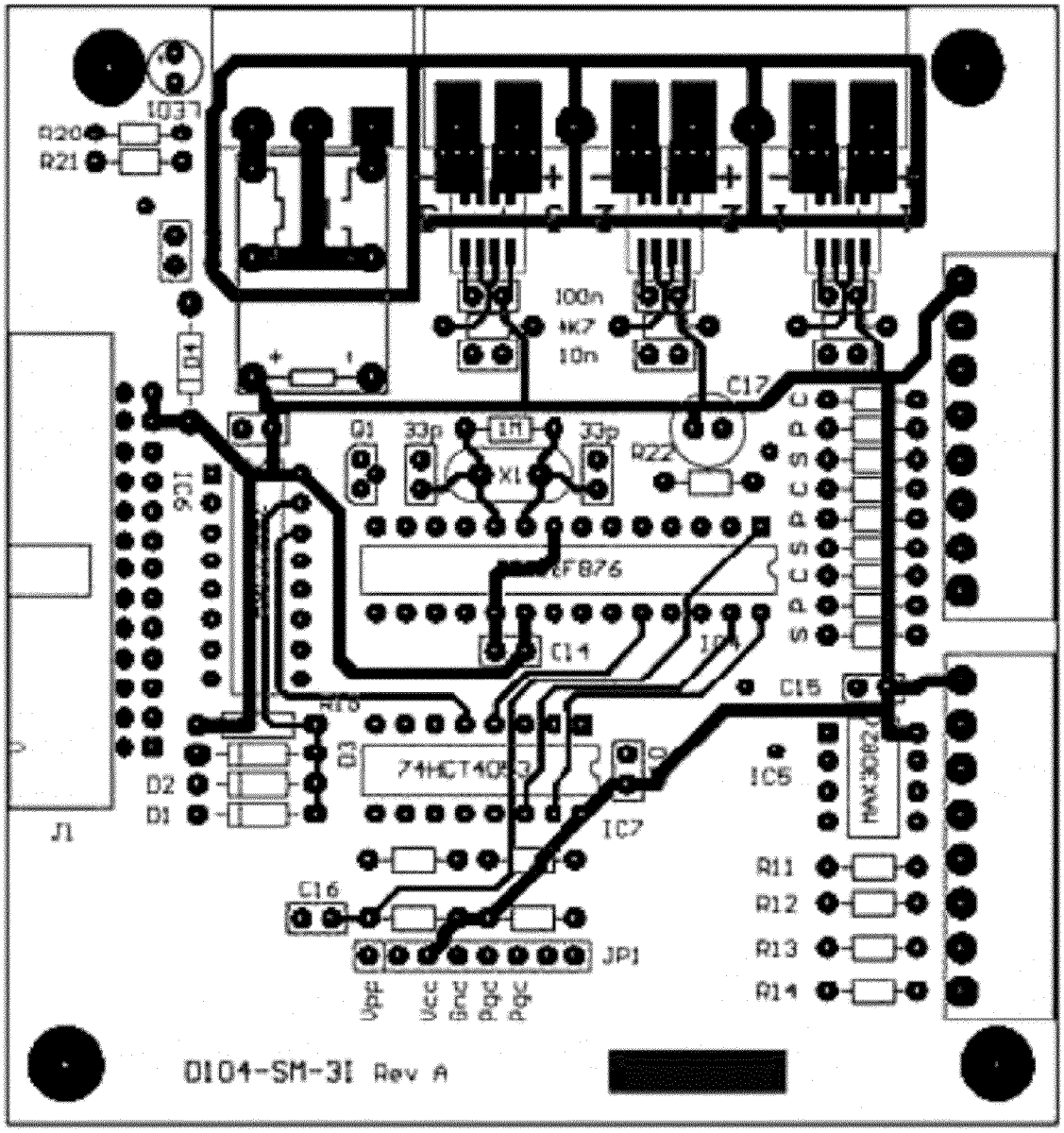
FIG. 14 shows a sensor module for the emergency escape system.

FIG. 14 shows a sensor module 1400 that can be used as a component of the elevator escape system and as a component of a facility management system.

Figure 15:
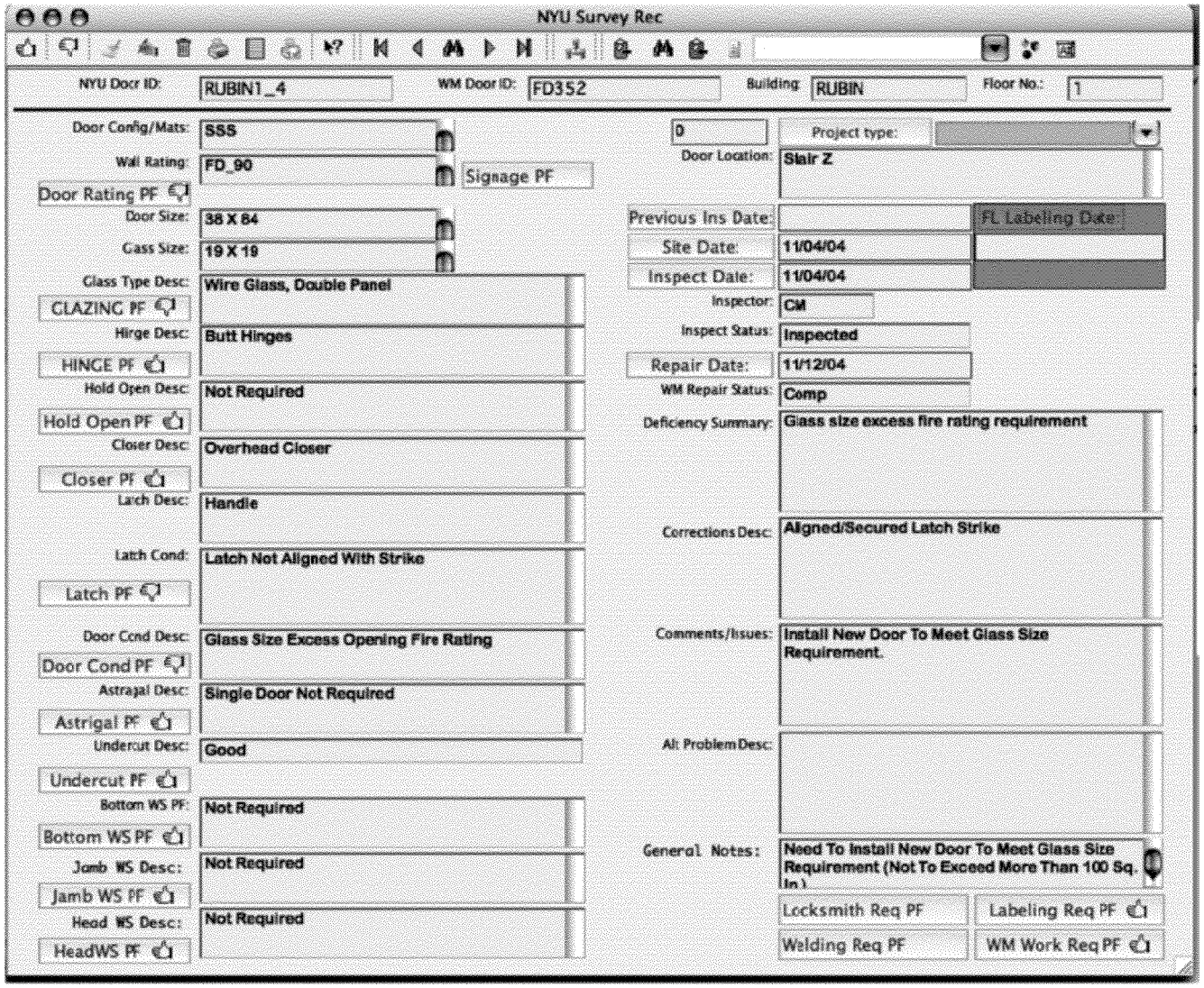
FIG. 15 depicts a screen capture of the functioning FacilitySoft installation software.

FIG. 15 depicts a screen capture of the functioning FacilitySoft installation software of an embodiment.

The present disclosure includes various processing steps, which will be described below. The steps of the present disclosure may be embodied in machine or computer executable instructions. The instructions can be used to cause a general purpose or special purpose system, which is programmed with the instructions to perform the steps of the present disclosure. Alternatively, the steps of the present disclosure may be performed by specific hardware components that contain hard-wired logic for performing the steps, or by any combination of programmed computer components and custom hardware components. While embodiments of the present disclosure will be described with reference to the Internet, the method and apparatus described herein is equally applicable to other network infrastructures or other data communications environments.

The firmware of the present disclosure relates to the activity of processing the information gathered from the hardware and applying decision making algorithms for the purpose of deriving a set of output states and output conditions. Although the firmware is written in the C programming language, the skilled artisan will recognize that other embodiments of the disclosure could be implemented with alternate computer programming languages. The firmware can be changed or rearranged to accommodate the adoption of new hardware.

In one particular aspect of the disclosure, the firmware is designed to be "cover all"—that is, the firmware is capable of controlling different types of appliance installations depending on the particular facility or site and the specific regulations governing particular appliances or barriers at such a facility or site. A configuration process which is conducted during installation, determines which control algorithm is to be executed. The firmware for controlling installations may be subject to applicable regulations of, for example, the National Fire Protection Agency (NFPA), American National Standards Institute (ANSI), Americans with Disabilities Act Accessibility Guidelines for Buildings and Facilities (ADAAG), Building Officials and Code Administrators (BOCA), Southern Building Code (SBC), International Building Code (IBC), Centers for Medicare and Medicaid Services (CMS), Joint Commission on Accreditation of Healthcare Organizations (JCAHO), United States Access Board, American Association of Automatic Door Manufactures (AAADM), Department of Homeland Security (DHS), Emergency Management and Response Information Sharing and Analysis Center (FEMA's EMRISAC), as well as various state departments of health and other state agencies. FIG. 13 depicts a screen capture of FacilitySoft installation software.

The elevator communication system of the present disclosure utilizes a suite of software tools such as (FacilitySoft) in the management of and communication with a controller. Connection to a controller is can be over a secure communications channel which may only be established by an authorized, and suitably identified, operator. Software tools from the FacilitySoft suite which are available to the operator may be based on the operator type. Installation personnel, for example, will access the Signal Set Verification tool to check each input's and each output's wiring and operability of an offline controller. Maintenance operators will have access to the controller's diagnostic and test tools for online verification of the controller's performance. Commissioning operators will, in addition to the above toolsets, will be able to access the controller's configuration data set for review and/or modification. Client administrative staff are recognized for access to the journal. Government inspector or an client auditor, will have searchable access to the controller's journal for extraction of reports. Typically this would be for the extraction of reports of system inspections. An emergency and/or event responder may access the controller for the acknowledgment of an event/emergency and/or review of real time conditions. Logging (recording) of the operator's identity and session time may be provided in the FacilitySoft interface.

Program storage and runtime variables storage can be within the microcontroller where the program is executed from read only memory (ROM). The preferred firmware of the disclosure comprises a kernel and a logic solver. The preferred kernel performs housekeeping services and input/output (I/O) services. The logic solver code makes the decisions according to the input states delivered to it by the kernel and sets outputs which are passed to the kernel to action.

In an embodiment, the intelligent, integrated elevator communication system, of the devices of the system, (e.g., controllers), are capable of self-assessment whereby the state of the elevator communication system network is internally analyzed and assessment points or monitoring thresholds, (e.g., flags) are set accordingly. In one embodiment, the assessment flags are included in the journal. The present elevator communication system may be configured such that any node in the system can review any other node's assessment flag(s) and communicate that journal to another node or nodes in the system along with its own assessment flags, which would include all its child nodes.

Thus, a data packet including journaled assessment flags can be communicated throughout the hierarchy level with each node adding its assessment with the destination being the root node. The root node can then decide to communicate directly to the child node to extract information from its stored journal. When each node has point to point connection, and when each node can assume the role of child, parent or root, the system provides hierarchical redundancy of significant data and increased probability of salvaging useful system information in the event that the system sustains catastrophic damage. A node failing to respond to the communication of an assessment flag may be reported quickly and efficiently to the root node, so that necessary remedial action may be taken.

Even if controller of the present disclosure is autonomous by default, however, the system of the disclosure may be designed to adjust and adapt to the operating environment by sharing a pooled knowledge base. For example, if part of a floor (and its monitoring node) of a building is suddenly destroyed, a parent node conducting while a routine scheduled scan of its related child nodes, will "learn" of the non-existence of the node on that part of the floor. The parent node may then interrogate its related nodes to find which nodes contain the last recorded data package from the floor's node. A redundant node on the west wing on the same floor as the destroyed node may respond and the interrogating parent node may then request an audit from the redundant node. The audit may reveal, for instances an unusual rate of rise of oxygen concentration in the destroyed section of the floor. Using this information, the system may then apply a revised real-time "lessons learned" alarm threshold and, using a validated supervisory control command, broadcast this new alarm threshold to the appropriate controllers throughout the system to be incorporated into the system's logic solve process.

Preferably the logic solver is able to generate messages for dispatch through the asynchronous I/O channel. Typically, this is an RS-232 or RS-485 link for delivery to local devices. Alarm messages or informational messages may be dispatched. This service can also receive incoming messages for the logic solver. Additionally, audio messages are able to be delivered to external speakers through the sound service. The logic solver nominates the message to be played.

Preferably the hardware set incorporates an Ethernet interface which allows the controller to exist on a network. While the same activity that exists on the terminal service could be conducted through the network, security requirements may dictate that this channel be used only for outgoing informational transactions. Also, in particular embodiments, hardware resources for level 1 (JTAG) and level 2 (ETM) debug are embedded into the microcontroller core.

Preferably the above-described system is an "open system" which is configured to work with a variety of components, applications, electric and electronic inputs and over-arching information systems. In one embodiment, the elevator communication systems of the disclosure are capable of supporting virtually all presently known open protocols and communication standards including, but not necessarily limited to the following: IEC 61131-3 Open programming standard adopted widely for micro PLCs and PAC, the CoDeSys automation alliance; all 750 series I/O modules; industrial asset management control standards such as OPC and HART, protocols that are backward compatible and provide digital communication as well as connection to the 4-20 mA analog signal; SEMI E54 for sensor actuator networks; LonWorks building automation protocol (preliminary EC standard #EN14908); ANSI, NIST, IEEE, CCIA supporting protocols; ELA interface standards (RS-232); PCMCIA memory card standards; XAPIA X.400 standards; W3C and IETF Internet standards; JEDEC IC standards; ETSI European telecom standards; IEC, ISO and ITU International standards; and JEIDA Japanese electronics standards.

While embodiments and applications have been shown and described, it would be apparent to those skilled in the art having the benefit of this disclosure that many more modifications than mentioned above are possible without departing from the inventive concepts disclosed herein. The invention, therefore, is not to be restricted except in the spirit of the appended claims.

What is claimed is:

1. An emergency escape system comprising:

an interposing device removably attached to an elevator cab and attached to a lift cable, the lift cable configured to move the elevator cab and interposing device together when electrical communication between the elevator cab and a machine room is present, wherein the interposing device is disconnected from the elevator cab when electrical communication between the elevator cab and the machine room is lost;

an emergency cable coupled to the interposing device and the elevator cab, wherein the emergency cable is configured to lower the elevator cab from the interposing device when electrical communication between the elevator cab and the machine room is lost.

2. The system of claim 1 further comprising a rescue housing engageable with the lift cable, wherein the rescue housing is configured to ascend and descend on the lift cable.

3. The system of claim 2, wherein the rescue housing comprises a power unit and a drive unit.

4. The system of claim 1, wherein the interposing device is removably attached to the elevator cab with a hydraulic interlock.

5. The system of claim 1 further comprising a winch mounted to the emergency cable, wherein the winch comprises a motor, and wherein a battery bank provides power to the motor of the winch.

6. The system of claim 1, wherein the interposing device is thermally fortified to withstand temperatures up to and including about 2100° F.

7. The system of claim 1, further comprising sensors attached to the elevator cab, wherein the sensors are configured to detect ambient conditions selected from the group consisting of: temperature, noxious gasses, combustible gases, smoke, and a combination thereof.

8. The system of claim 7 further comprising sensors attached to the elevator cab, the interposing device, and each floor of an elevator shaft, wherein the sensors produce an output, wherein the output of the sensors is communicated to a control unit of the elevator cab, and wherein the control unit controls the descent of the elevator cab based on the output.

9. The system of claim 1, wherein the elevator cab is attached to guide rails provided in an elevator shaft.

10. A method comprising:

moving an interposing device and elevator cab together via a lift cable, the interposing device and the elevator cab attached to the lift cable during normal operations;

disconnecting the elevator cab from the interposing device during an emergency, an emergency cable coupled to the interposing device and the elevator cab; and providing power to a motor of a winch coupled to the emergency cable to lower the elevator cab from the interposing device during the emergency.

11. The method of claim 10, further comprising measuring conditions at the elevator cab.

12. The method of claim 11 wherein a determination to ascend or descend the elevator cab is based on the measured conditions.

13. The system of claim 1 wherein the interposing device is configured to shield the elevator cab in the event of a collision on the anterior end of the cab.

14. The system of claim 1 further comprising a battery coupled to the elevator cab to provide power to electrical components of the elevator cab.

15. The system of claim 10, wherein the power is provided by a battery coupled to the elevator cab and to provide power to electrical components of the elevator cab.

16. The system of claim 1 wherein the elevator cab comprises a control unit to send and receive wireless communications.

* * * * *